US006805567B2

(12) United States Patent
Chapman et al.

(10) Patent No.: US 6,805,567 B2
(45) Date of Patent: Oct. 19, 2004

(54) POWER DISTRIBUTION SYSTEM

(75) Inventors: Gordon F. Chapman, Butler, IN (US); Frank Roe, Wolcottville, IN (US); Randall L. Bixler, LaGrange, IN (US); Phil Zimmerman, Hamilton, IN (US)

(73) Assignee: Pent Products, Inc., Kendallville, IN (US)

( * ) Notice: Subject to any disclaimer, the term of this patent is extended or adjusted under 35 U.S.C. 154(b) by 27 days.

(21) Appl. No.: 10/213,047

(22) Filed: Aug. 6, 2002

(65) Prior Publication Data

US 2004/0029445 A1 Feb. 12, 2004

(51) Int. Cl.[7] ..... H01R 27/00
(52) U.S. Cl. ..... 439/215
(58) Field of Search ..... 439/215, 654, 439/440, 105, 107, 49, 211, 170, 222, 640, 535, 557, 71, 171, 173, 188, 189; 174/53, 50.52, 59

(56) References Cited

U.S. PATENT DOCUMENTS

| | | | | | |
|---|---|---|---|---|---|
| 4,235,495 | A | | 11/1980 | Propst et al. | 339/22 |
| 4,295,697 | A | * | 10/1981 | Grime | 439/215 |
| 4,688,869 | A | | 8/1987 | Kelly | 439/209 |
| 5,013,252 | A | | 5/1991 | Nienhuis et al. | 439/215 |
| 5,057,647 | A | * | 10/1991 | Bogden et al. | 174/48 |
| 5,112,240 | A | | 5/1992 | Nienhuis et al. | 439/215 |
| 5,236,370 | A | * | 8/1993 | King et al. | 439/215 |
| 5,252,086 | A | * | 10/1993 | Russell et al. | 439/215 |
| 5,318,454 | A | * | 6/1994 | Deer et al. | 439/215 |
| 5,503,565 | A | * | 4/1996 | McCoy | 439/171 |
| 5,562,469 | A | * | 10/1996 | Nienhuis et al. | 439/215 |
| 5,655,933 | A | * | 8/1997 | Skowronski | 439/654 |
| 5,941,720 | A | * | 8/1999 | Byrne | 439/215 |
| 6,247,961 | B1 | | 6/2001 | McCoy | 439/439 |
| 6,575,777 | B2 | * | 6/2003 | Henriott et al. | 439/215 |

* cited by examiner

*Primary Examiner*—J. F. Duverne
(74) *Attorney, Agent, or Firm*—Taylor & Aust, P.C.

(57) ABSTRACT

A power distribution system has a plurality of interlockable elongated power distribution modules each including an insulative housing formed from two matable insulative housing portions enclosing a plurality of elongated conductors. Each housing portions includes an elongated rib and groove structure along an edge thereof for engaging a corresponding rib and groove structure of an adjacent power distribution module thereby allowing modules to be joined together. Each module includes a plurality of electrical connection stations disposed along the housing and electrically connected to insulation-free regions of at least some of the conductors by the spanning prongs of electrical connector terminals. Certain stations receive electrical receptacles and other stations receive power jumpers to supply electrical energy to and from the module. The conductors may be entirely insulation-free since the two housing portions include elongated walls for maintaining the elongated conductors spaced and electrically insulated from one another. Certain walls of one portion each cooperate with a corresponding wall of the other portion to form a barrier between individual conductors, and at least one of the certain walls of the one portion and a corresponding wall of the other portion including matable lip and groove sections for holding the two housing portions together.

16 Claims, 4 Drawing Sheets

POWER DISTRIBUTION SYSTEM

BACKGROUND OF THE INVENTION

1. Field of the Invention

The present invention relates to power distribution systems and more particularly to a power distribution system for supplying power to a plurality of locations such as spaced apart work stations and the like typically found in modular furniture environments.

2. Description of the Related Art

Modular wall panels and similar modular furniture installations frequently employ modular power distribution systems having electrical raceways containing wiring and electrical outlets as well as arrangements for conveying power from the electrical components of one raceway to another. Modular distribution systems allow the raceways to be simply plugged together facilitating easy electrical rearrangement when the modular furniture arrangement is modified. This eliminates the need for the services of an electrician when modifying the arrangement. One simple form of such a wiring system has a plurality of raceways serving work stations with each raceway coupled to an adjacent one by a pluggable jumper. One of the raceways is plugged to a source of electrical energy and the remaining ones receive power sequentially from an adjacent one by way of the jumpers. This form may employ only one circuit having conventional hot, neutral and ground wires, or multiple circuits may be disposed in individual raceways. Typically, metallic raceways enclose insulated electrical conductors and raceway assembly (as opposed to rearrangement) requires conductor insulation stripping, attachment of the stripped conductor ends to connectors, or similar labor intensive acts.

It would be highly desirable to eliminate the need for conductor insulation coatings and its attendant selective removal while maintaining location and electrical isolation between the conductors.

SUMMARY OF THE INVENTION

The present invention provides insulative power distribution modules having interior walls and/or barriers for maintaining conductor alignment and electrical separation while facilitating desired electrical connections to the conductors.

The invention comprises, in one form thereof, an elongated power distribution module having an insulative housing including two matable insulative housing portions and a plurality of elongated conductors with insulation-free regions disposed within the housing. Each of the two housing portions includes internal elongated walls for maintaining the elongated conductors spaced and electrically insulated from one another. Some of the walls of one portion cooperate with a corresponding wall of the other portion to form a barrier between individual conductors. At least one of the walls of the one portion and a corresponding wall of the other portion include matable lip and groove sections for holding the two housing portions together. Cooperating obliquely inclined walls of each housing portion urge the two housing portions orthogonally to the direction of elongation and the matable lip and groove sections into juxtaposition as the two portions are moved toward one another.

An advantage of the present invention is that the power distribution module housing is held together by internal snap features eliminating the need for fasteners or other external joining features.

Another advantage is the elimination of the need for metallic coverings of insulated conductors.

A further advantage is that the jumper and receptacle stations are self securing plastic inserts and neither they nor the jumper plugs and receptacles they receive require attachment screws or clips.

A still further advantage is the provision of barrier and/or support walls as integral interior parts of an insulating powerway.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 1:
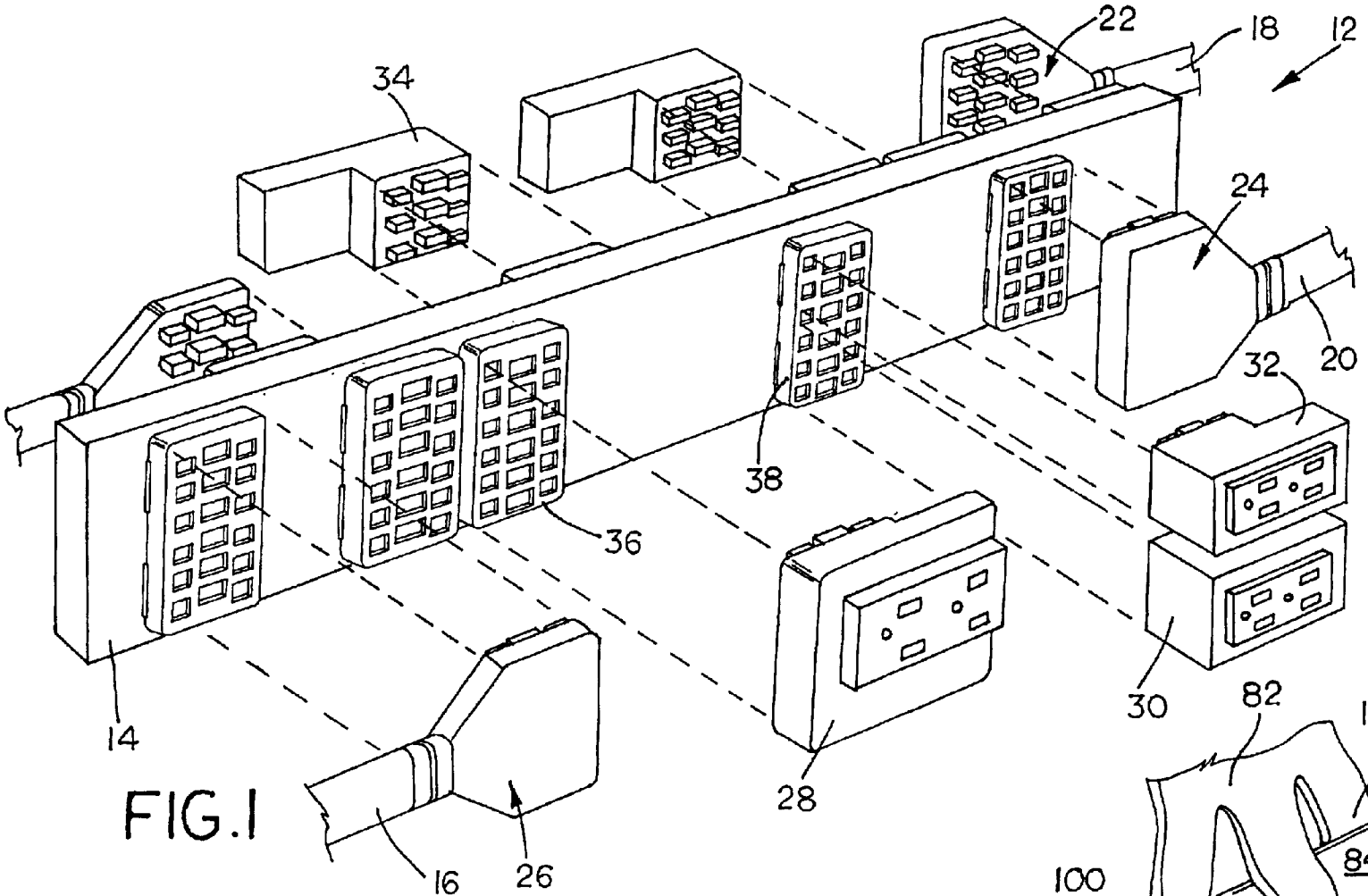
FIG. 1 is an exploded isometric view of a power distribution system according to the invention in one form.
Figures 2, 10:
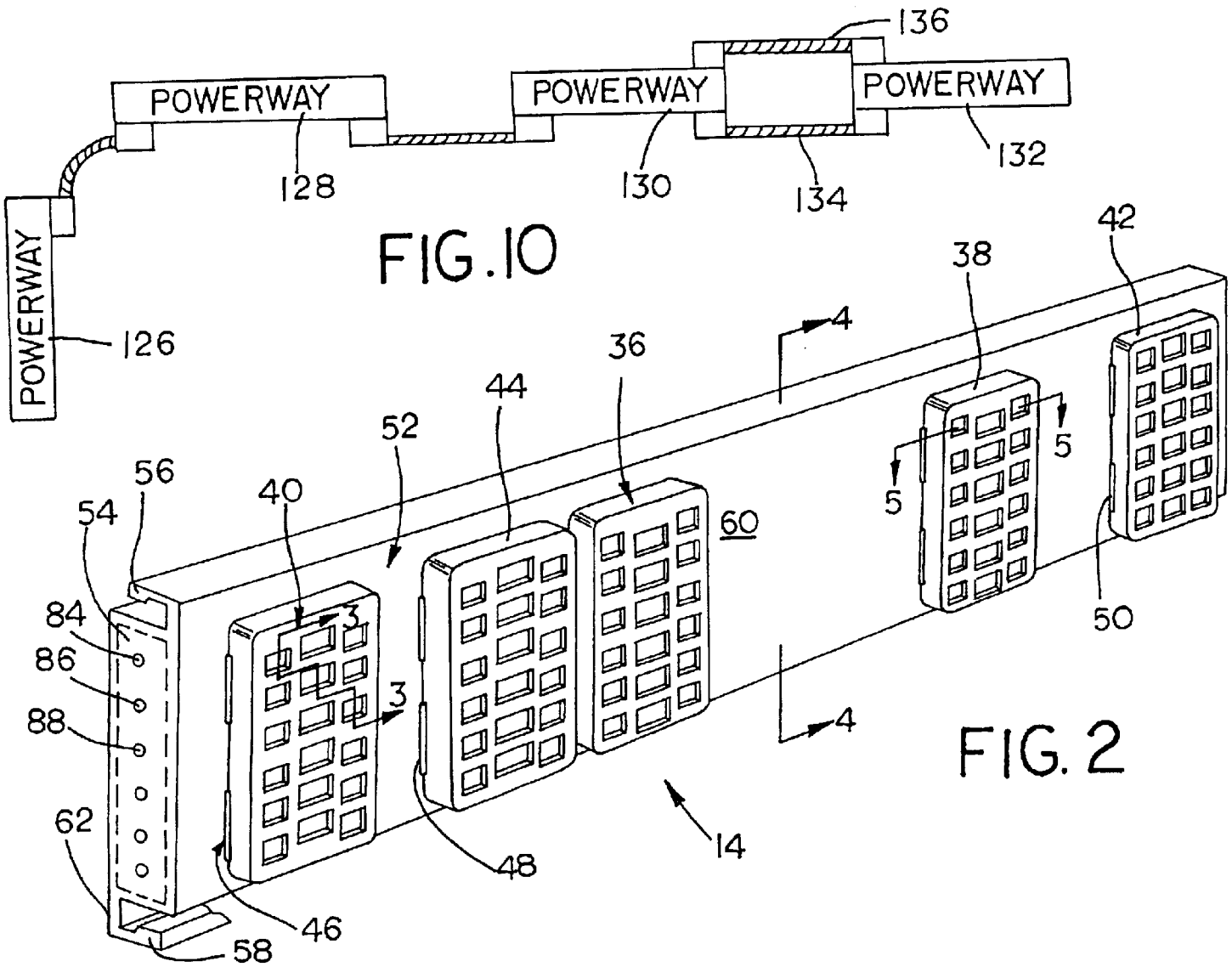
FIG. 2 is a more detailed isometric view of the powerway of FIG. 1.
FIG. 10 is a simplified plan view of an in-line interconnection of powerways.
Figure 4:
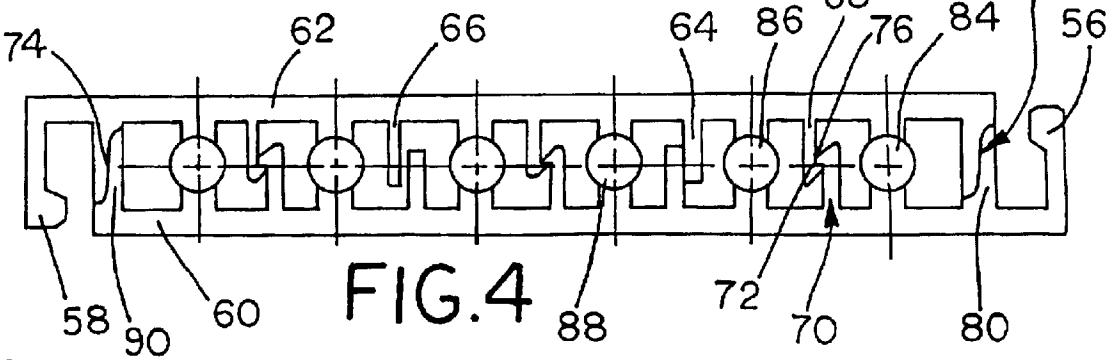
FIG. 4 is a cross-sectional view along line 4—4 of FIG. 2

Referring now to the drawings and particularly to FIG. 1, there is shown a power distribution system 12 having an insulated elongated power distribution module or powerway 14 the housing of which is formed of two matable insulative housing portions 60 and 62 (FIGS. 2 and 4). Typically, these portions are formed as extruded insulating portions of generally uniform cross-sectional configuration. In use, the modules may be affixed to partitions, desks or other structures. A plurality of electrical connection stations 36, 38, 40, 42 and 44 are disposed along the housing and electrically connected to insulation-free regions of conductors within the module or powerway. Certain ones of the stations, 36 and 38, for example, are for receiving electrical receptacles and other stations such as 40, 42 and 44 are for receiving power jumpers to supply electrical energy to and from the module. Electrical jumpers such as 16, 18 and 20 having plugs such as 22, 24 and 26 for connection to jumper stations such as 40, 42 and 44 provide power from a source or serve to convey power between powerways. Electrical receptacles 28, 30, 32 and 34 may be plugged to receptacles stations such as 36 and 38. These receptacles may, for example, be similar to those shown in U.S. Pat. No. 5,584,714. Snap in place station retention arrangements such as 46, 48 and 50 serve to retain the receptacle and jumper stations in position on the housing 52. The housing ends are closed by end caps such as 54. Typically, the insulative end caps are located at the opposite extremities of the elongated extruded insulating portions 60 and 62. An arrangement for joining two adjacent modules is depicted in FIGS. 2 and 4, but not shown in FIG. 1.

In FIG. 2, note the extruded plastic front housing portion 60 includes an elongated stacking hook or rib 56 near the upper edge thereof while the rearward housing portion 62 includes a similar hook 58. These hooks provide each housing portion with an elongated rib and groove structure along an edge thereof for engaging a corresponding rib and groove structure of an adjacent power distribution module thereby allowing modules to be joined together. When two similar modules are positioned one over the other, the lower stacking hook of the upper module may be mated with the upper stacking hook of the lower module, that is, the rib of one extends latchingly into the groove of the other and the rib of the other into the groove of the first. The housing 52 electrically insulates and supports a plurality of elongated conductors such as 84, 86 and 88 which have insulation-free regions such as shown at 106 in FIG. 6, disposed within the housing. In many cases, the conductors may be entirely free of insulative coatings since the powerway housing itself provides electrical insulation as well as support and conductor separation. This separation is best seen in FIG. 4.

In FIG. 4, several elongated walls such as 64 66, 68 and 70 function to maintain the insulation-free conductors such as 84, 86 and 88 mechanically spaced and electrically isolated one from another. Some of the walls, 68 and 70, for example, also include elongated interlockable hooks which function to latch the two housing portions 60 and 62 together. Wall 68 has a groove 72 which receives a lip 76 for holding the two housing portions together. These cooperating hooks are urged into interengagement by obliquely inclined wall surfaces 74, 78, 80 and 90. An obliquely inclined wall surface of one portion cooperates with a corresponding obliquely inclined wall surface of the other portion to urge the two housing portions 60 and 62 orthogonally to the direction of elongation (toward the left as viewed in FIG. 4) as the two portions are moved toward one another.

Figure 5:
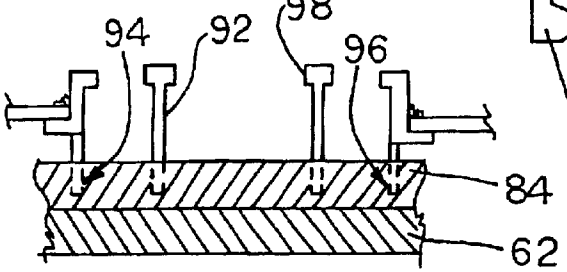
FIG. 5 is a cross-sectional view along line 5—5 of FIG. 2

The housing portions 60 and 62 deviate from uniform cross-sectional configurations at selected station locations for receiving the electrical connection stations. The housing portion elongated walls are interrupted at some of the electrical connection stations as illustrated in FIG. 5, and replaced by a plurality of support walls 92, 94, 96, 98 which extend from housing portion 62 to support, separate and insulate conductors one from another.

Figure 6:
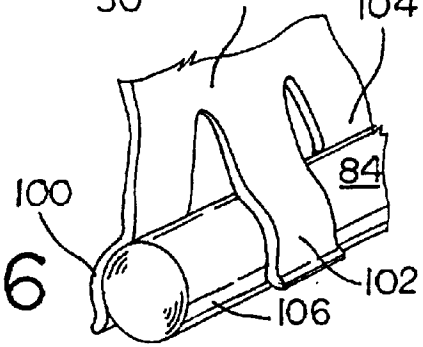
FIG. 6 is an isometric view of an illustrative station terminal and powerway conductor.
Figure 3:
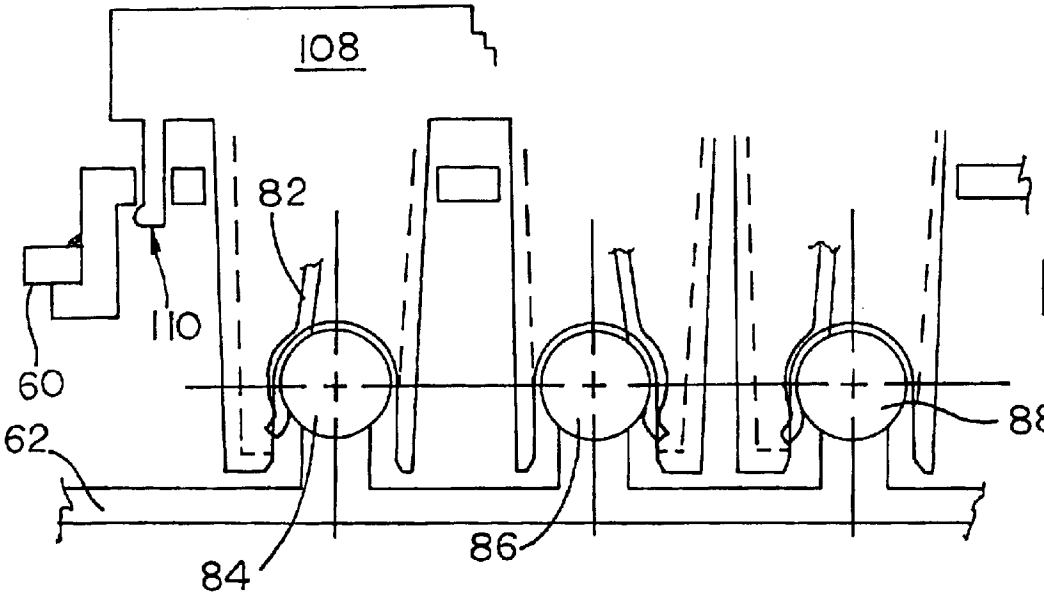
FIG. 3 is a cross-sectional view along line 3—3 of FIG. 2

Electrical connection to the elongated conductors is achieved by a plurality of spring clip connectors which may, for example, be of the type disclosed in U.S. Pat. No. 6,247,961 or as illustrated in FIGS. 3 and 6. In FIG. 3, a jumper or receptacle holder 108 has several latch mechanisms such as 110 holding the station in place on the extrusion or housing portion 60. Each electrical connection station or holder includes a plurality of spring clip electrical connectors 82, 84 and 86 each having at least two opposed prongs 100, 102, 104 for spanning and electrically connecting to an insulation-free section 106 of a corresponding conductor. Each spring clip connector further includes contacts such for connecting to a corresponding contact of a removable electrical receptacle or a removable power jumper plug.

Figures 7, 8, 9:
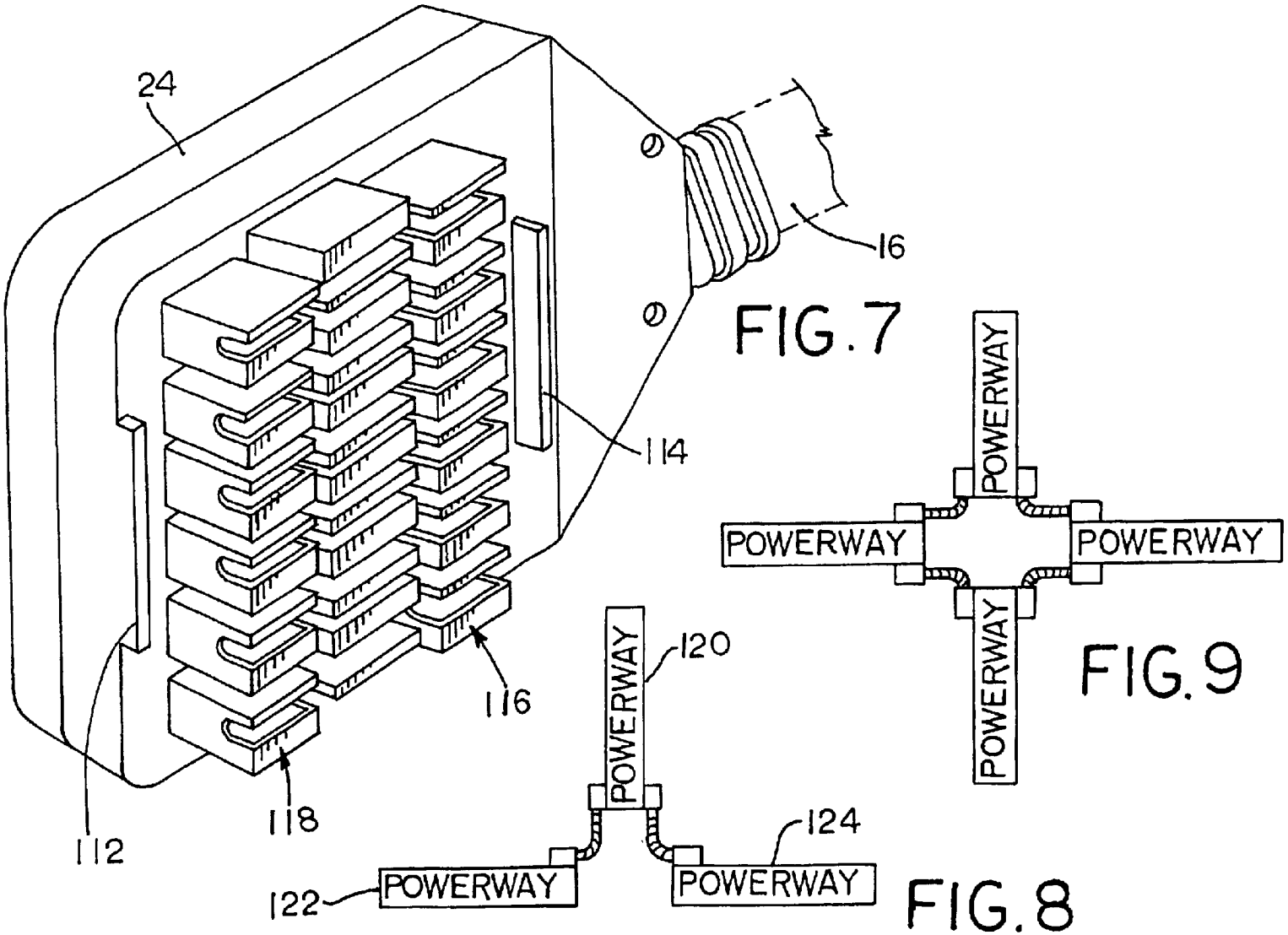
FIG. 7 is an isometric view of an illustrative power jumper and jumper plug.
FIG. 8 is a simplified plan view of a "T" interconnection of powerways.
FIG. 9 is a simplified plan view of an "X" interconnection of powerways.

Latches similar to 110 are shown at 112 and 114 on an illustrative power or jumper plug 24 in FIG. 7. Some of the towers such as 116 and 118 include recessed electrical connectors for contacting mating terminals in the jumper stations.

Illustrative wiring schemes are shown in FIGS. 8–10. FIG. 8 shows a "T" connection with powerway 120 connected intermediate two other powerways 122 and 124. In this illustration power input would typically be to 122 or 124. FIG. 9 shows one of several ways to achieve an "X" interconnection while FIG. 10 illustrates a linear configuration comprising an "L" or corner between powerways 126 and 128 followed by an in-line connection to 130 and an end of run connection to 132. The jumpers 134 and 136 are not parallel or redundant connections, but rather supply distinct circuits between 130 and 132.

In summary, the extruded insulative module housing halves facilitate assembly as well as conductor spacing and insulation while allowing easy electrical connections to the conductors. One module may hold one or more receptacles in each receptacle station. Each module may contain one or several separate circuits. The powerway modules may be stacked or clipped together by adjacent integral rib and groove structures.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An elongated power distribution module comprising:

an insulative housing including at least two matable insulative housing portions;

a plurality of elongated conductors having insulation-free regions disposed within the housing; and a plurality of electrical connection stations disposed along the housing and electrically connected to insulation-free regions of at least some of the conductors, certain of said stations for receiving electrical receptacles and other of said stations for receiving power jumpers to supply electrical energy to and from the module, each of said plurality of electrical connection stations including a plurality of spring clip connectors each having at least two opposed prongs for spanning and electrically connecting to a corresponding conductor.

2. The module of claim 1, wherein at least one of said housing portions includes elongated walls for maintaining the elongated conductors spaced and electrically insulated from one another.

3. The module of claim 2, wherein two of said housing portions include elongated walls for maintaining the elongated conductors spaced and electrically insulated from one another, certain walls of one portion cooperating with a corresponding wall of the other portion to form a barrier between individual conductors.

4. The module of claim 3, wherein at least one of the certain walls of the one portion and a corresponding wall of the other portion include matable lip and groove sections for holding the two housing portions together.

5. The module of claim 4, wherein the matable lip and groove sections comprise like elongated interlockable hooks.

6. The module of claim 2, wherein each of said two housing portions comprises an elongated extruded insulating portion of generally uniform cross-sectional configuration.

7. The module of claim 6, wherein the housing further includes insulative end caps at the opposite extremities of the elongated extruded insulating portions.

8. The module of claim 6, wherein the housing portions deviate from uniform cross-sectional configurations at selected station locations for receiving the electrical connection stations.

9. The module of claim 1, wherein each of two housing portions include an elongated rib and groove structure along an edge thereof for engaging a corresponding rib and groove structure of an adjacent power distribution module thereby allowing modules to be joined together.

10. The module of claim 1, wherein each conductor is insulation-free throughout the entire extent thereof.

11. The module of claim 1, wherein each spring clip connector further includes contacts for connecting to a corresponding contact of a removable electrical receptacle or a removable power jumper plug.

12. An elongated power distribution module, comprising:

an insulative housing including at least two matable insulative housing portions;

a plurality of elongated conductors having insulation-free regions disposed within the housing; and a plurality of electrical connection stations disposed along the housing and electrically connected to insulation-free regions of at least some of the conductors, certain of said stations for receiving electrical receptacles and other of said stations for receiving power jumpers to supply electrical energy to and from the module, two of said housing portions include elongated walls for maintaining the elongated conductors spaced and electrically insulated from one another, certain walls of one portion cooperating with a corresponding wall of the other portion to form a barrier between individual conductors, at least one of the certain walls of the one portion and a corresponding wall of the other portion include matable lip and groove sections for holding the two housing portions together, said matable lip and groove sections comprise like elongated interlockable hooks, each of said two housing portions further includes at least one wall having an obliquely inclined wall surface, an obliquely inclined wall surface of one portion cooperating with a corresponding obliquely inclined wall surface of the other portion to urge the two portions orthogonally to the direction of elongation as the two portions are moved toward one another.

13. An elongated power distribution module, comprising:

an insulative housing including at least two matable insulative housing portions;

a plurality of elongated conductors having insulation-free regions disposed within the housing; and a plurality of electrical connection stations disposed along the housing and electrically connected to insulation-free regions of at least some of the conductors, certain of said stations for receiving electrical receptacles and other of said stations for receiving power jumpers to supply electrical energy to and from the module, two of said housing portions include elongated walls for maintaining the elongated conductors spaced and electrically insulated from one another, certain walls of one portion cooperating with a corresponding wall of the other portion to form a barrier between individual conductors, the elongated wall portions are interrupted at some of the electrical connection stations, and replaced by a plurality of support walls extending from only one housing portion to support, separate and insulate conductors one from another.

14. A power distrbution system, comprising a plurality of interlockable elongated power distribution modules, each module including an insulative housing including at least two matable insulative housing portions, and a plurality of elongated conductors disposed within the housing; each of said two housing portions including an elongated rib and groove structure along an edge thereof for engaging a corresponding rib and groove structure of an adjacent power distribution module thereby allowing modules to be joined together, each module includes a plurality of electrical connection stations disposed along the housing and electrically connected to insulation-free regions of at least some of the conductors, certain of said stations for receiving electrical receptacles and other of said stations for receiving power jumpers to supply electrical energy to and from the module, each of said plurality of electrical connection stations including a plurality of spring clip connectors each having at least two opposed prongs for spanning and electrically connecting to a corresponding conductor.

15. The module of claim 14, wherein two of said housing portions include elongated walls for maintaining the elongated conductors spaced and electrically insulated from one another, certain walls of one portion cooperating with a corresponding wall of the other portion to form a barrier between individual conductors, and at least one of the certain walls of the one portion and a corresponding wall of the other portion including matable lip and groove sections for holding the two housing portions together.

16. An elongated power distribution module, comprising:

an insulative housing including two matable insulative housing portions and a plurality of elongated conductors having insulation-free regions disposed within the housing, each of said two housing portions including elongated walls for maintaining the elongated conductors spaced and electrically insulated from one another, certain walls of one portion cooperating with a corresponding wall of the other portion to form a barrier between individual conductors, at least one of the certain walls of the one portion and a corresponding wall of the other portion include matable lip and groove sections for holding the two housing portions together, each of said two housing portions further includes at least one wall having an obliquely inclined wall surface, an obliquely inclined wall surface of one portion cooperating with a corresponding obliquely inclined wall surface of the other portion to urge the two portions orthogonally to the direction of elongation and the matable lip and groove sections into juxtaposition as the two portions are moved toward one another.

* * * * *